US010328717B2

(12) United States Patent
Zheng et al.

(10) Patent No.: US 10,328,717 B2
(45) Date of Patent: Jun. 25, 2019

(54) MARKING METHOD AND DEVICE, AND REPAIR SYSTEM FOR DISPLAY PANEL

(71) Applicants: BOE Technology Group Co., Ltd., Beijing (CN); Chengdu BOE Optoelectronics Technology Co., Ltd., Sichuan Province (CN)

(72) Inventors: Zijian Zheng, Beijing (CN); Zemin Wu, Beijing (CN); Junyang Xiao, Beijing (CN); Zhihui Yang, Beijing (CN); Xicong Li, Beijing (CN); Song Li, Beijing (CN); Bo Wang, Beijing (CN); Wei Guo, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan Province (CN)

( * ) Notice: Subject to any disclaimer, the term of this patent is extended or adjusted under 35 U.S.C. 154(b) by 0 days.

(21) Appl. No.: 15/841,944

(22) Filed: Dec. 14, 2017

(65) Prior Publication Data

US 2018/0297375 A1 Oct. 18, 2018

(30) Foreign Application Priority Data

Apr. 17, 2017 (CN) ..... 2017 1 0250305

(51) Int. Cl.

| | |
|---|---|
| ***B41J 2/435*** | (2006.01) |
| ***B41J 2/13*** | (2006.01) |
| ***B41J 2/14*** | (2006.01) |

(52) U.S. Cl.

CPC ..... *B41J 2/435* (2013.01); *B41J 2/13* (2013.01); *B41J 2/14* (2013.01); *B41J 2002/14193* (2013.01)

(58) Field of Classification Search

CPC ..... H01L 22/12; H01L 33/54; H01L 33/58; H01L 2224/14; H01L 2933/0058;

(Continued)

(56) References Cited

U.S. PATENT DOCUMENTS 3,857,041 A 12/1974 Spicer
5,889,518 A * 3/1999 Poreh ..... G06F 9/451 715/804

(Continued)

FOREIGN PATENT DOCUMENTS

CN 1443628 A 9/2003
CN 101556384 A 10/2009

(Continued)

OTHER PUBLICATIONS

Chinese Office Action for Chinese Application No. 201710250305.1 dated Feb. 2, 2018.

*Primary Examiner* — Anh T Vo

(57) ABSTRACT

The present disclosure relates to a marking method and device, and a repair system for a display panel in the field of display panel detection. The marking device includes: magnifying component and a marking component. The magnifying component is configured to magnify a target position point on a target object, and the marking component is configured to mark the target position point on the target object in accordance with the magnified target position point. The present disclosure may solve the problem that the operation process of marking the defective position point is complicated and simplify the operation process of marking the defective position point. The present disclosure may mark the defects of the display panel.

16 Claims, 11 Drawing Sheets

(58) Field of Classification Search
CPC ..... B41J 2/435; B41J 2/14; B41J 2/13; B41J 2002/14193
See application file for complete search history.

(56) References Cited

U.S. PATENT DOCUMENTS

| | | | | |
|---|---|---|---|---|
| 5,964,040 | A * | 10/1999 | Keene | B24B 13/0055 33/28 |
| 6,707,437 | B1 * | 3/2004 | Kuno | G06F 3/147 313/292 |
| 6,751,620 | B2 * | 6/2004 | Orbanes | G06F 3/0346 |
| 8,179,604 | B1 * | 5/2012 | Prada Gomez | G02B 27/0093 345/8 |
| 9,543,221 | B2 | 1/2017 | Park et al. | |
| 2015/0177826 | A1 * | 6/2015 | Aizawa | G06F 3/01 345/173 |

FOREIGN PATENT DOCUMENTS

| | | | |
|---|---|---|---|
| CN | 104793374 | A | 7/2015 |
| CN | 205467922 | U | 8/2016 |

* cited by examiner

MARKING METHOD AND DEVICE, AND REPAIR SYSTEM FOR DISPLAY PANEL

CROSS-REFERENCE TO RELATED APPLICATION

This application claims priority to Chinese Patent Application No.: 201710250305.1, filed with the State Intellectual Property Office on Apr. 17, 2017 and titled "Marking Method and Device," which is incorporated herein by reference in its entirety.

TECHNICAL FIELD

The present disclosure relates to the field of display panel detection, and more particularly to a marking method and device, and a repair system for display panels.

BACKGROUND

In the field of display panel detection, it is often necessary to mark a defective position point of the display panel, so as to repair the defect of the display panel in accordance with the marked defective position point.

In the related art, in a lighting state of the display panel, a worker may observe the display panel with naked eyes and adopt a dustless pen or mark pen to mark the defective position point with a "#-shaped mark" or a "+-shaped mark" after the defective position point on the display panel is observed. Afterwards, the worker may adopt a magnifier to magnify the marked defective position point and determine whether the marked defective position point is accurate or not in accordance with the magnified defective position point.

In the process of implementing the present disclosure, at least the following problem is found in the related art: the defective position point needs to be confirmed by adopting a magnifier after it's marked, thus the operation process of marking the defective position point is complicated.

SUMMARY

The present disclosure provides a marking method and device and a repair system for display panels.

In a first aspect, there is provided a marking device. The marking device includes a magnifying component and a marking component. The magnifying component is configured to magnify a target position point on a target object, and the marking component is configured to mark the target position point on the target object in accordance with the magnified target position point.

In some embodiments, the marking device further includes an adjusting component. The adjusting component is connected to the marking component and configured to adjust a marking angle of the marking component to align the marking component with the target position point.

In some embodiments, the marking device further includes an auxiliary adjusting component. The auxiliary adjusting component is disposed in the marking component and configured to assist the adjusting component in adjusting the marking angle of the marking component.

In some embodiments, the marking component includes an inkjet configured to jet ink to the target position point so as to mark the target position point.

In some embodiments, the inkjet includes an ink cartridge and a nozzle communicated with the ink cartridge. The auxiliary adjusting component includes an infrared laser aligner. The infrared laser aligner is disposed in the nozzle and infrared rays emitted by the infrared laser aligner are collinear with the axis of the nozzle. The adjusting component is configured to adjust the ink jetting angle of the nozzle in accordance with the infrared rays emitted by the infrared laser aligner.

In some embodiments, the inkjet further includes a recycling case. The recycling case is communicated with the nozzle and configured to recycle residual ink in the nozzle.

In some embodiments, the adjusting component includes an adjusting knob, an adjusting part and m adjusting gears meshed in sequence, and m is an integer greater than or equal to 1. The adjusting knob is provided with a rotary gear. The rotary gear is meshed with a first adjusting gear of the m adjusting gears, the shaft of a second adjusting gear of the m adjusting gears is fixedly connected to the adjusting part, the nozzle is fixedly disposed on the adjusting part, and the first adjusting gear and the second adjusting gear are adjusting gears disposed at both ends among the m adjusting gears meshed in sequence.

In some embodiments, the nozzle is a piezoelectric stack nozzle.

In some embodiments, the marking device further includes a power supply component connected to the piezoelectric stack nozzle and configured to supply power to the piezoelectric stack nozzle.

In some embodiments, the marking device further includes a control component electrically connected to the nozzle and the infrared laser aligner respectively and configured to control the infrared laser aligner to emit infrared rays and control the nozzle to jet ink.

In some embodiments, the control component includes a nozzle switch electrically connected to the nozzle and an aligner switch electrically connected to the infrared laser aligner.

In some embodiments, the marking device further includes a jet head support of a hollow structure and provided with a knob opening and a nozzle opening. The ink cartridge, the nozzle, the recycling case, the infrared laser aligner, the adjusting knob, the adjusting part, the m adjusting gears and the power supply component are all disposed in the jet head support. The adjusting knob partially extends out of the knob opening, and the ink jetted by the nozzle is enabled to be jetted out of the jet head support through the nozzle opening.

In some embodiments, the marking device further includes a magnifier body of a hollow structure and fixedly connected to the jet head support. The magnifying component includes a magnifying lens disposed in the magnifier body.

In some embodiments, the nozzle is provided with a penetration hole, and the infrared laser aligner is enabled to pass the nozzle through the penetration hole.

In some embodiments, the value range of an aperture of the penetration hole is 20 micrometers to 30 micrometers.

In some embodiments, m is equal to 3.

In a second aspect, there is provided a marking method of a marking device. The marking device includes a magnifying component and a marking component. The method includes: magnifying a target position point on a target object by the magnifying component; and marking the target position point on the target object by the marking component in accordance with the magnified target position point.

In some embodiments, before the target position point on the target object is marked by the marking component in accordance with the magnified target position point, the method further includes: adjusting the marking angle of the marking component by an adjusting component to align the marking component with the target position point.

In some embodiments, adjusting the marking angle of the marking component by an adjusting component includes: assisting the adjusting component in adjusting the marking angle of the marking component by an auxiliary adjusting component.

In a third aspect, there is provided a repair system of a display panel. The system includes a marking device including a magnifying component and a marking component. The magnifying component is configured to magnify a target position point on a target object, and the marking component is configured to mark the target position point on the target object in accordance with the magnified target position point.

It is to be understood that both the foregoing general description and the following detailed description are exemplary only, and are not intended to limit the present disclosure.

BRIEF DESCRIPTION OF THE DRAWINGS

To describe the technical solutions in the embodiments of the present disclosure more clearly, the following briefly introduces the accompanying drawings required for describing the embodiments. Apparently, the accompanying drawings in the following description show merely some embodiments of the present disclosure, and a person of ordinary skill in the art may still derive other drawings from these accompanying drawings without creative efforts.

The drawings herein are incorporated in and constitute a part of this specification of the present disclosure, showing embodiments consistent with the present disclosure, and explaining the principles of the present disclosure together with the description.

DETAILED DESCRIPTION

In order to clarify the objects, technical solutions and advantages of the present disclosure, the present disclosure will be further described in detail in connection with the drawings.

In the field of display, a defective position point on a Cell product (for example, a display panel) needs to be marked frequently, so as to repair the defect of the Cell product. Generally, a dustless pen or a mark pen may adopted to mark the defective position point with a "+-shaped mark" or a "#-shaped mark". During marking, the Cell product may be lighted on at first (i.e., lighting the Cell product), then the Cell product is observed with naked eyes in the lighting state and the defective position point is estimated. After the defective position point is estimated, a dustless pen or a mark pen may be adopted to mark the defective position point with the "+-shaped mark" or the "#-shaped mark". Afterwards, the marked defect position point is confirmed with a high magnified glass. At present, the surface profile, shape, and the like of an object may be observed by using a common high magnified glass on the market, but the current high magnified glass lacks the function of accurately marking the position point on the object. As a result, once the high magnified glass is taken away, it is very difficult to seek for the marked defective position point again.

Figure 1:
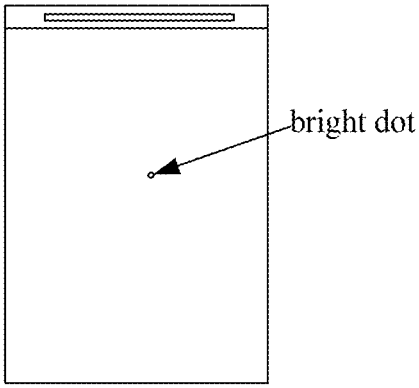
FIG. 1 is a schematic view of a defective bright dot on a display panel provided in the related art.
Figure 2:
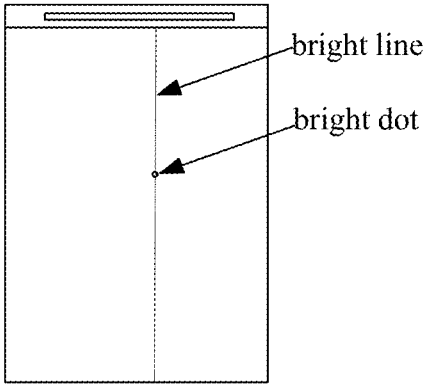
FIG. 2 is a schematic view of a defective Bit line on a display panel provided in the related art.

In practice, a majority of no good (NG) Cell products are accompanied with the defect of a bright dot and/or a Bit line (the Bit line is a dim bright line in the lighting state), etc. Such type of defects generally take sub-pixel as a unit and have a magnitude of micrometers (μm), and are hard to be accurately observed with naked eyes. Besides, the defective position point is hard to be accurately marked by adopting the dustless pen or the mark pen. Therefore, a big marking error may be generated, and mistakes may be easily made in the subsequent process of repairing the Cell products, thereby causing the Cell products which could be repaired originally to be directly NG, and greatly affecting the improvement of productivity and yield The defect of a bright dot may be as shown in FIG. 1, and the defect is caused by the damage to a sub-pixel conducting layer. The defect of a Bit line may be as shown in FIG. 2, and the defect is caused by the bright dots corresponding to the bit line. The defective position point may be marked with a "+-shaped mark" or a "#-shaped mark" when the defect as shown in FIG. 1 and/or FIG. 2 is repaired. Nevertheless, accurate marking seems to be particularly difficult since the sub-pixel is very small.

Figure 3:
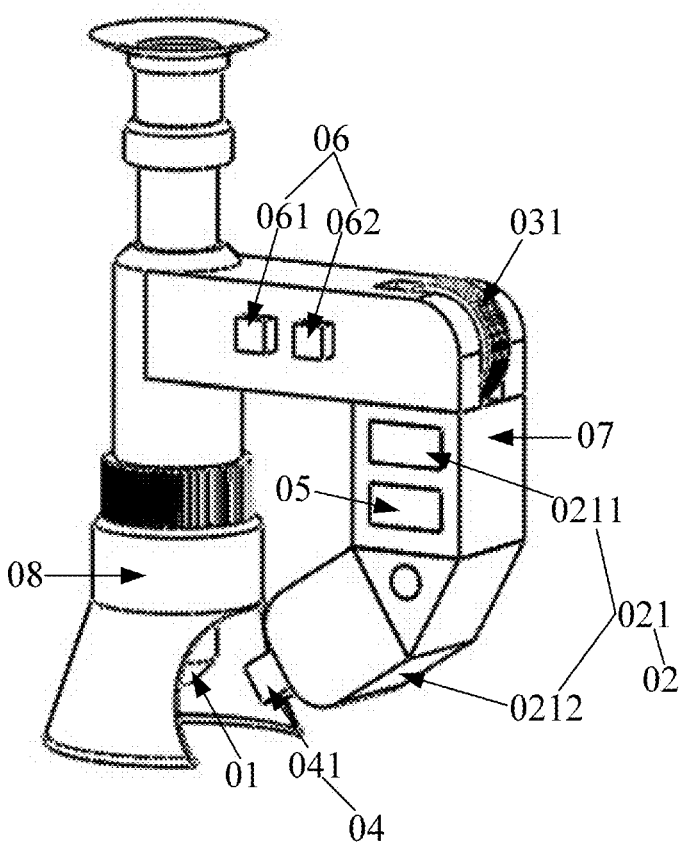
FIG. 3 is a three-dimensional structural schematic view of a marking device provided in the present disclosure.

Referring to FIG. 3, which shows a three-dimensional structural schematic view of a marking device provided in the embodiments of the present disclosure. Referring to FIG. 3, the marking device comprises a magnifying component 01 and a marking component 02.

The magnifying component 01 is configured to magnify a target position point (not shown in FIG. 3) on a target object (not shown in FIG. 3). The marking component 02 is configured to mark the target position point on the target object in accordance with the magnified target position point. In the embodiments of the present disclosure, the target object may be a display panel, and may be a liquid crystal display panel, an organic light-emitting diode (OLED) display panel or a quantum dot light emitting diodes (QLED) display panel. The target position point may be a defective position point, which may be, for example, a bright dot, etc.

In conclusion, in accordance with the marking device provided in the embodiments of the present disclosure, the marking component can mark the target position point on the target object in accordance with the target position point magnified by the magnifying component, and the target position point on the target object can be the defective position point on the display panel. Therefore, there is no need to confirm the defective position point after marking, and it is helpful for solving the problem of the complicated operation process of marking the defective position point in the related art and simplifying the operation process of marking the defective position point.

Figure 4:
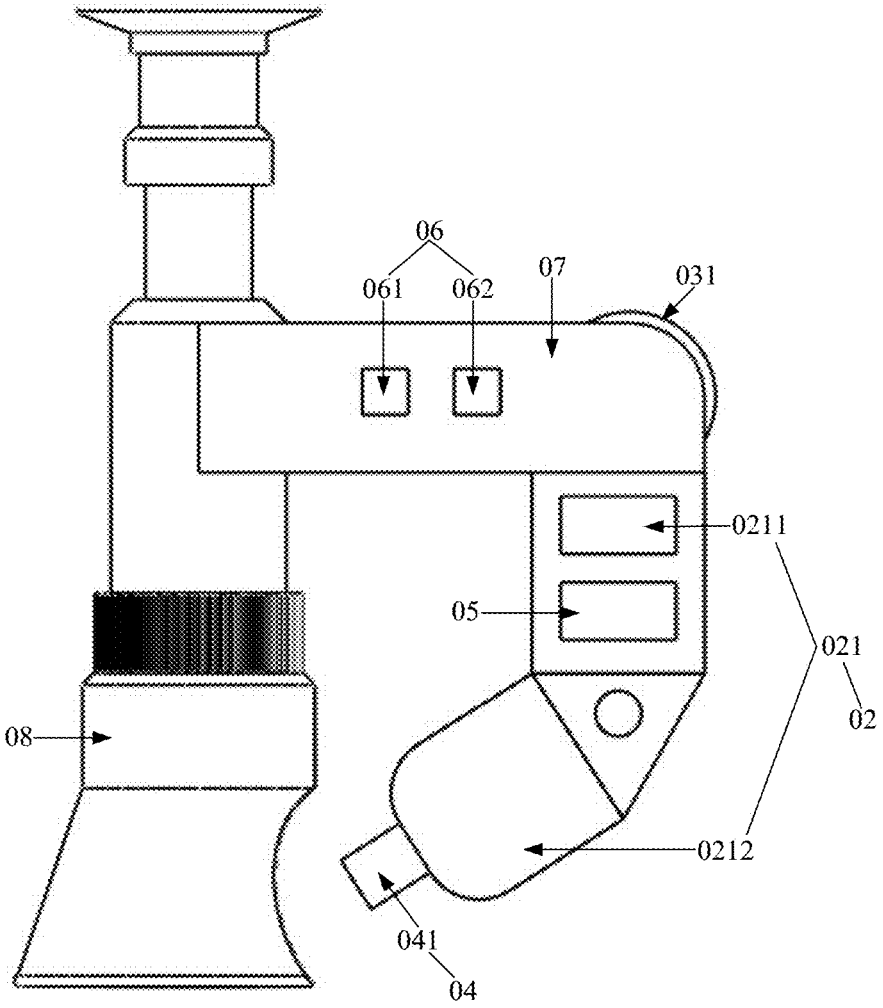
FIG. 4 is a front view of a marking device provided in the present disclosure.
Figure 5:
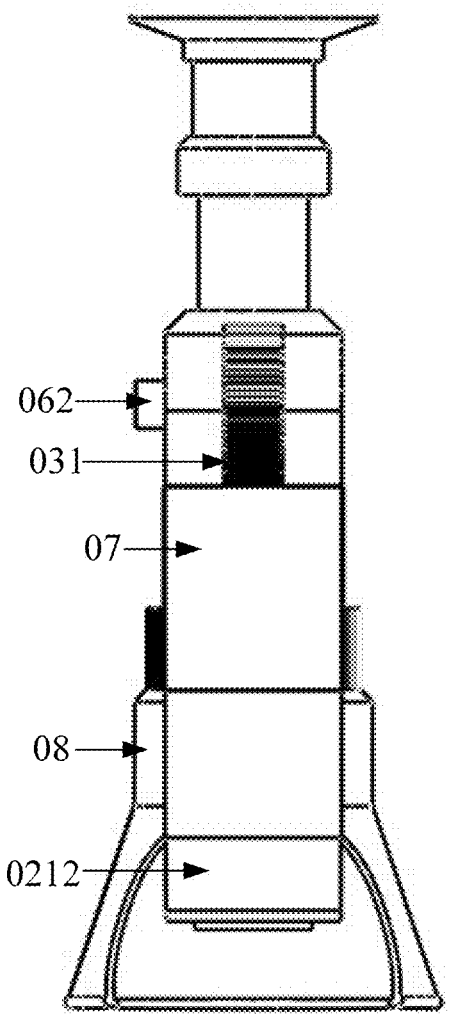
FIG. 5 is a side view of a marking device provided in the present disclosure.
Figure 6:
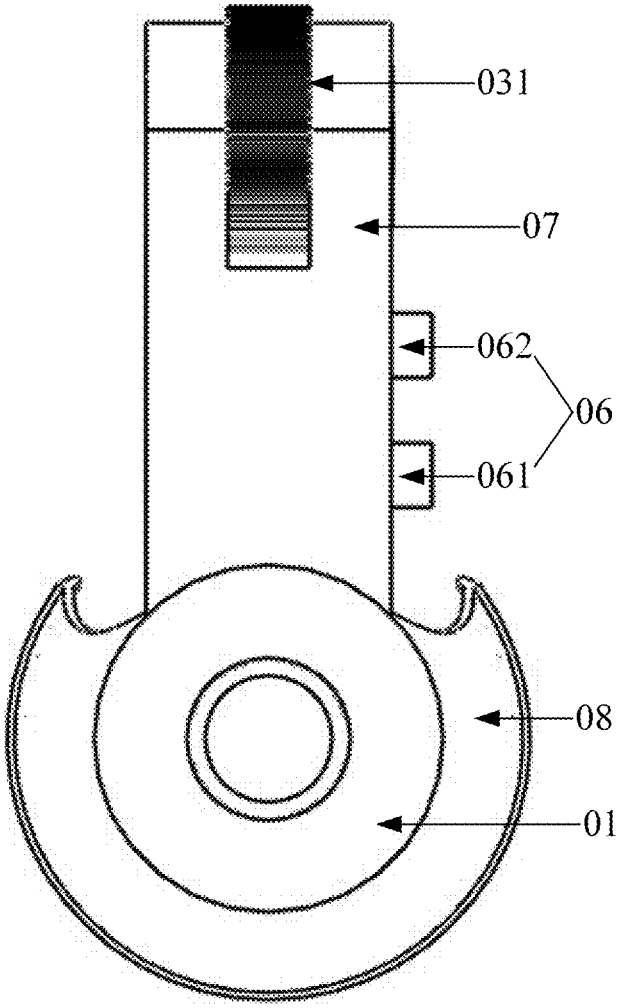
FIG. 6 is a top view of a marking device provided in the present disclosure.
Figure 7:
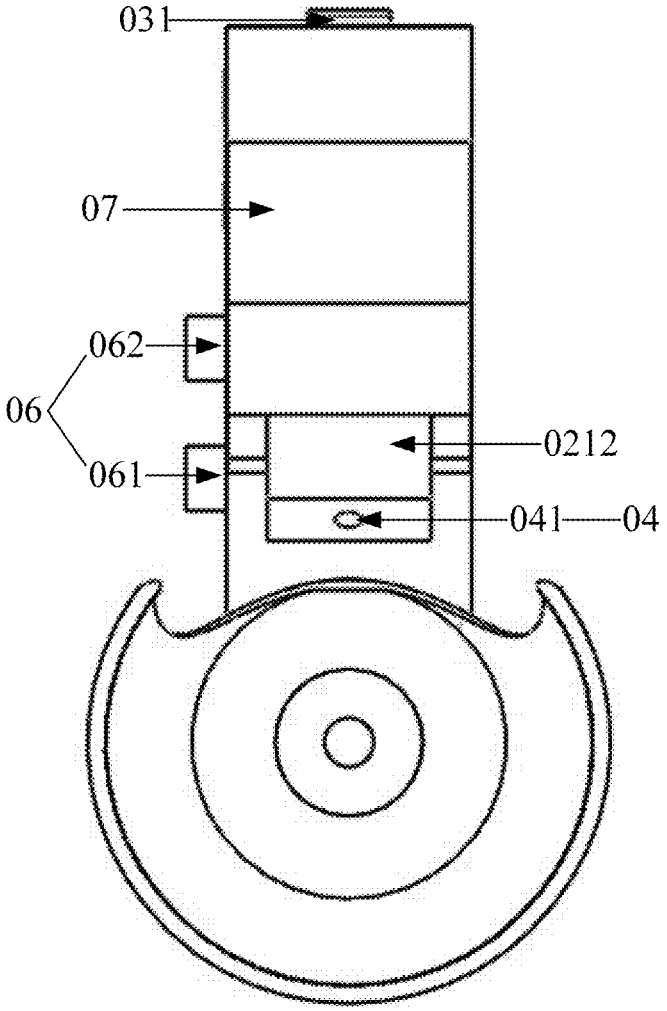
FIG. 7 is a bottom view of a marking device provided in the present disclosure.
Figure 8:
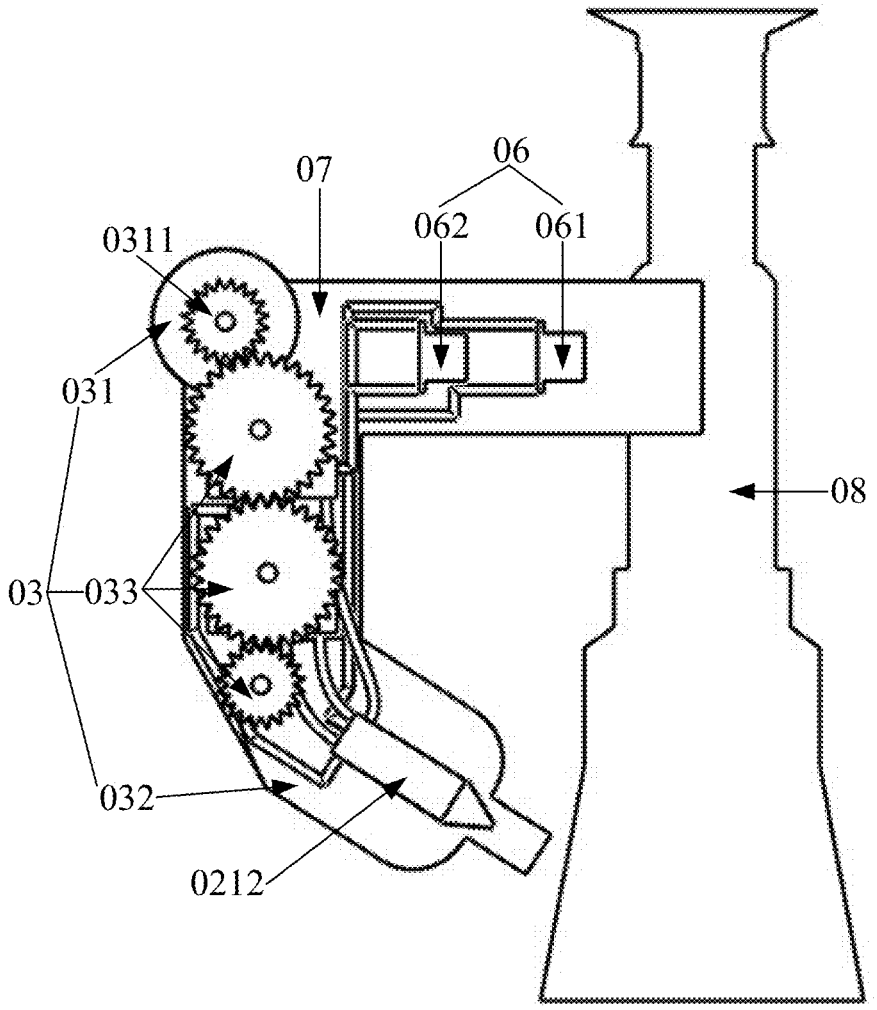
FIG. 8 is a schematic view of an internal structure of a marking device provided in the present disclosure.
Figure 9:
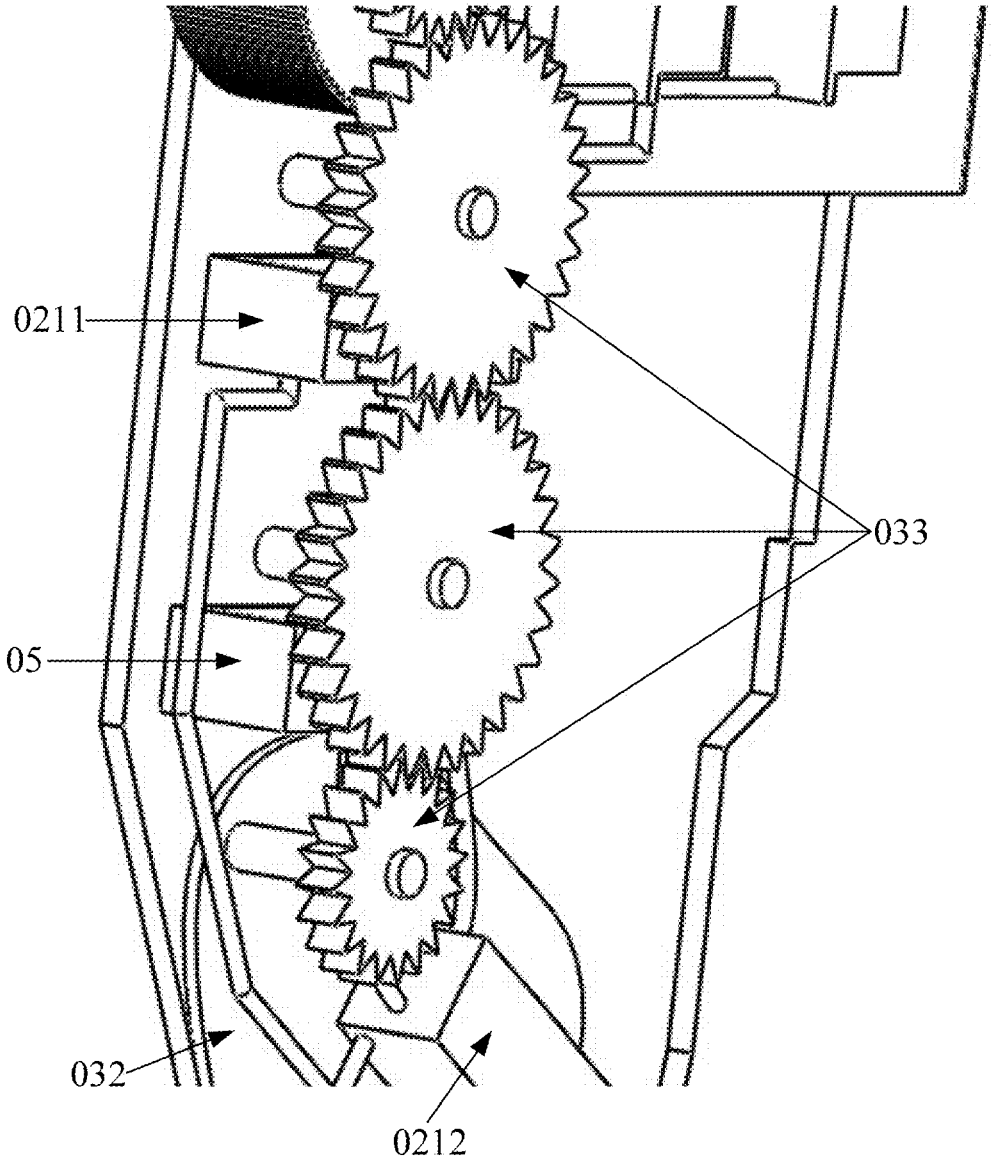
FIG. 9 is a schematic view of a partial region of a marking device provided in the present disclosure.
Figure 10:
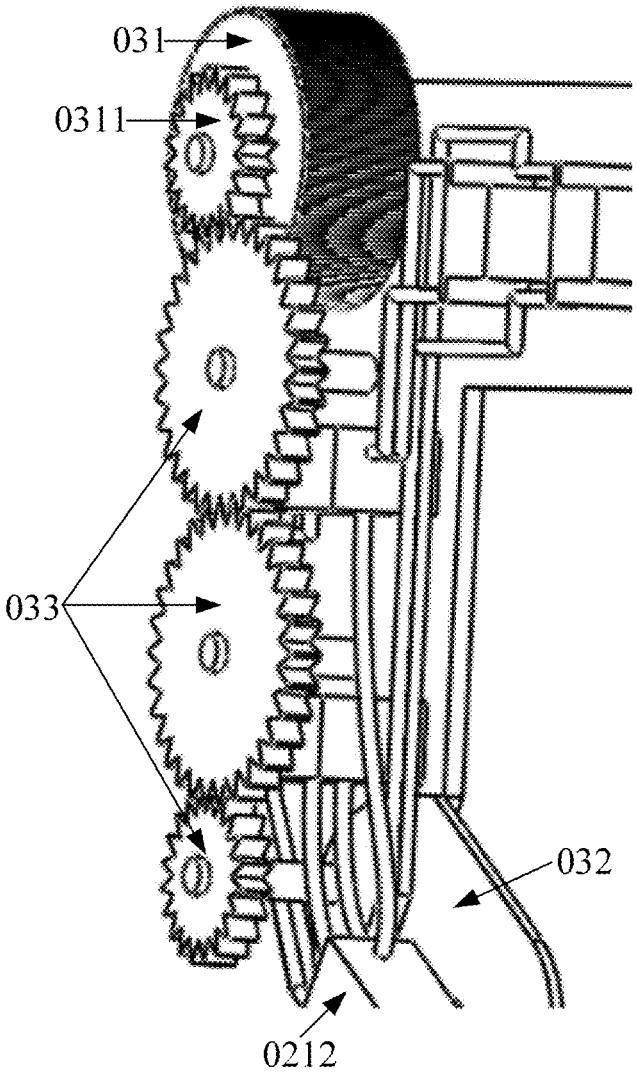
FIG. 10 is a schematic view of another partial region of a marking device provided in the present disclosure.

FIG. 4 is a front view of a marking device provided in the embodiments of the present disclosure. FIG. 5 is a side view of a marking device provided in the embodiments of the present disclosure. FIG. 6 is a top view of a marking device provided in the embodiments of the present disclosure. FIG. 7 is a bottom view of a marking device provided in the embodiments of the present disclosure. FIG. 8 is a schematic view of an internal structure of a marking device provided in the embodiments of the present disclosure. FIG. 9 and FIG. 10 respectively show enlarged views of partial regions of a marking device provided in the embodiments of the present disclosure respectively. Referring to FIG. 3 to FIG. 10, the marking device further comprises an adjusting component 03. The adjusting component 03 is connected to the marking component 02 and is configured to adjust a marking angle of the marking component 02, to align the marking component 02 with the target position point. In some embodiments, the adjusting component 03 comprises an adjusting knob 031, an adjusting part 032 and m adjusting gears 033 meshed in sequence, and m is an integer greater than or equal to 1. The adjusting knob 031 is provided with a rotary gear 0311. The rotary gear 0311 is meshed with a first adjusting gear among the m adjusting gears 033, and the shaft (not shown in FIG. 3 to FIG. 10) of a second adjusting gear among the m adjusting gears is fixedly connected to the adjusting part 032. A nozzle 0212 is fixedly disposed on the adjusting part 032. The first adjusting gear and the second adjusting gear are adjusting gears disposed at both ends among them adjusting gears 033 meshed in sequence. The value of m may be set in accordance with actual needs and in some embodiments, m may be equal to 3. In the embodiments of the present disclosure, the adjusting component 03 comprises a plurality of gears, which may enable the marking angle of the marking component 02 to be freely adjusted.

Continuing to refer to FIG. 3 to FIG. 10, the marking device further comprises an auxiliary adjusting component 04. The auxiliary adjusting component 04 is disposed in the marking component 02. The auxiliary adjusting component 04 may comprise an infrared laser aligner 041 and is configured to assist the adjusting component 03 in adjusting the marking angle of the marking component 02. In some embodiments, the infrared laser aligner 041 may emit infrared rays, and the projection point of the infrared rays emitted by the infrared laser aligner 041 on the target object may coincide with the target position point. The adjusting component 03 may adjust the marking angle of the marking component 02 in accordance with the infrared rays emitted by the infrared laser aligner 041, to align the marking component 02 with the target position point. Here, the infrared laser aligner 041 may be a high precision infrared sensor.

Continuing to refer to FIG. 3 to FIG. 10, the marking component 02 comprises an inkjet 021. The inkjet 021 is configured to jet ink to the target position point. After the ink is jetted to the target position point, the ink may mark the target position point. Therefore, the marking component 02 provided by the embodiments of the present disclosure may mark the target position point by jetting the ink. The ink may be semitransparent, and the transparency of the ink may be 50%. Of course, the transparency of the ink may be other values in practice, and is not limited by the embodiments of the present disclosure. In the embodiments of the present disclosure, the inkjet 021 may comprise an ink cartridge 0211 and a nozzle 0212 communicated with the ink cartridge 0211. The ink cartridge 0211 is configured to hold ink and is provided with a cover. After the ink in the ink cartridge 0211 is used up, the cover may be opened to refill the ink into the ink cartridge 0211. The infrared laser aligner 041 of the auxiliary adjusting component 04 may be disposed in the nozzle 0212 and the infrared rays emitted by the infrared laser aligner 041 may be collinear with the axis (not shown in FIG. 3 to FIG. 10) of the nozzle 0212. In some embodiments, the nozzle 0212 is located ahead of the infrared laser aligner 041 and is provided with a penetration hole. The infrared laser aligner 041 may pass the nozzle 0212 through the penetration hole of the nozzle 0212. That is, the infrared laser aligner 041 may partially extend out of the nozzle 0212 through the penetration hole of the nozzle 0212. The value range of the aperture of the penetration hole may be 20 micrometers to 30 micrometers to avoid the leakage of ink from the nozzle 0212. For example, the aperture of the penetration hole is 22 micrometers or 25 micrometers, etc. The adjusting component 03 is configured to adjust an ink jetting angle of the nozzle 0212 in accordance with the infrared rays emitted by the infrared laser aligner 041. In some embodiments, the infrared laser aligner 041 may emit infrared rays, and the adjusting component 03 may adjust the ink jetting angle of the nozzle 0212 in accordance with the infrared rays emitted by the infrared laser aligner 041, such that the projection point of the infrared rays emitted by the infrared laser aligner 041 on the target object coincides with the target position point Here, the nozzle 0212 is aligned with the target position point, and the nozzle 0212 may jet ink to the target position point. In some embodiments, the inkjet 021 may further comprise a recycling case (not shown in FIG. 3 to FIG. 10) communicated with the nozzle 0212, and the recycling case is configured to recycle the residual ink in the nozzle 0212, thereby realizing the recycle of the ink. In the embodiments of the present disclosure, the nozzle 0212 may be a piezoelectric stack nozzle, and the piezoelectric stack nozzle may adopt a piezoelectric stack technology to enhance the electric field around the nozzle, such that the ink in the nozzle 0212 is jetted out of the nozzle 0212 at a high speed under the action of the electric field, and the jetted ink drops are tiny, fast in jetting speed and high in precision. In the embodiments of the present disclosure, the ink may be an oily material, which is convenient to wipe the mark after the subsequent defect repair is finished. It should be noted that the embodiment of the present disclosure takes an example in which the nozzle 0212 is a piezoelectric stack nozzle for explanation. In practice, the nozzle 0212 may not be a piezoelectric stack nozzle. In this case, a booster may be disposed in the nozzle 0212 to enhance the electric field around the nozzle, such that the ink in the nozzle 0212 is jetted out of the nozzle 0212 under the action of the electric field. It should also be noted that in practice, the horizontal plane where the nozzle 0212 is may be lower than the horizontal plane where the magnifying component 01 is, so as to prevent the ink from being jetted onto the magnifying component 01.

In some embodiments, as shown in FIG. 3 to FIG. 10, the marking device further comprises a power supply component 05. The power supply component 05 may be connected to the piezoelectric stack nozzle (not shown in FIG. 3 to FIG. 10), and is configured to supply power to the piezoelectric stack nozzle. In the embodiments of the present disclosure, the power supply component 05 may comprise a battery case (not shown in FIG. 3 to FIG. 10) and a battery (not shown in FIG. 3 FIG. to 10) disposed in the battery case. The battery may be electrically connected to the piezoelectric stack nozzle and may be a button battery. It should be noted that in practice, the power supply component 05 may also be an external power source, which may be electrically connected to the piezoelectric stack nozzle and supply power to the piezoelectric stack nozzle.

Continuing to refer to FIG. 3 to FIG. 10, the marking device further comprises a control component 06. The control component 06 is electrically connected to the nozzle 0212 and the infrared laser aligner 041 respectively, and is configured to control the infrared laser aligner 041 to emit infrared rays and to control the nozzle 0212 to jet ink. As shown in FIG. 3 to FIG. 10, the control component 06 comprises a nozzle switch 061 and an aligner switch 062. The nozzle switch 061 is electrically connected to the nozzle 0212, and is configured to control the nozzle 0212. The aligner switch 062 is electrically connected to the infrared laser aligner 041, and is configured to control the infrared laser aligner 041. In some embodiments of the present disclosure, the nozzle switch 061 and the aligner switch 062 may comprise a switch button respectively. Users may operate the nozzle switch 061 by the switch button of the nozzle switch 061 such that the nozzle switch 061 may control the nozzle 0212, and users may operate the aligner switch 062 by the switch button of the aligner switch 062 such that the aligner switch 062 may control the infrared laser aligner 041. It should be noted that in the embodiments of the present disclosure, the "electrically connected" may refer to a connection via a conducting circuit. Of course, apart from this, the "electrically connected" may also refer to a coupled connection, and is not limited in the embodiments of the present disclosure. It should also be noted that in practice, the control component may be a controller, and the controller may control the nozzle and the infrared laser aligner.

Referring to FIG. 3 to FIG. 10, the marking device further comprises a jet head support 07. The jet head support 07 may be a hollow structure, and the jet head support 07 is provided with a knob opening (not shown in FIG. 3 to FIG. 10) and a nozzle opening (not shown in FIG. 3 to FIG. 10). The ink cartridge 0211, the nozzle 0212, the recycling case, the infrared laser aligner 041, the adjusting knob 031, the adjusting part 032, the m adjusting gears 033 and the power supply component 05 are all disposed in the jet head support 07. The adjusting knob 031 partially extends out of the knob opening of the jet head support 07, and the ink jetted out of the nozzle 0212 may be jetted out of the jet head support 07 through the nozzle opening of the jet head support 07. It should be noted that the embodiments of the present disclosure merely simply introduce the structure of the jet head support, and the detailed structure of the jet head support may be referenced to the related art. The detailed structure of the jet head support may be set in accordance with actual needs, and is not repeated in the embodiments of the present disclosure.

Continuing to refer to FIG. 3 to FIG. 10, the marking device further comprises a magnifier body 08. The magnifier body 08 may be a hollow structure, and the jet head support 07 is fixedly connected to the magnifier body 08. The magnifying component 01 may comprise a magnifying lens (not shown in FIG. 3 to FIG. 10). The magnifying lens is disposed in the magnifier body 08, and the magnifying component 01 is configured to magnify the target position point by the magnifying lens. It should be noted that the embodiments of the present disclosure merely simply introduce the structure of the magnifier body, and the detailed structure of the magnifier body may be referenced to the related art. The detailed structure of the magnifier body may be set in accordance with actual needs, and is not repeated in the embodiments of the present disclosure.

In conclusion, in accordance with the marking device provided in the embodiments of the present disclosure, the marking component can mark the target position point on the target object in accordance with the target position point magnified by the magnifying component, and the target position point on the target object can be the defective position point on the display panel. Therefore, there is no need to confirm the defective position point after marking, and it is helpful for solving the problem of the complicated operation process of marking the defective position point in the related art and simplifying the operation process of marking the defective position point.

The marking device provided in the embodiments of the present disclosure has a magnifying function and an automatic ink jetting function. The marking device can magnify the defects, such as a sub-pixel point, by 50 times in the lighting state of a Cell product or a chip on glass (COG). Besides, ink may be jetted to mark the defective sub-pixel point (i.e., defective position point) by way of manually operating the switch button. Thus, it is convenient for accurately observing and repairing the defective position point later on a repair device. The marking device provided in the embodiments of the present disclosure is particularly applicable to mark the bright dot defect and the Bit line defect of an OLED product, and can improve productivity and products' yield.

The marking device provided by the embodiments of the present disclosure may be applied to the marking method below. The marking method and marking device in the embodiments of the present disclosure may be referenced to each other. For the marking method, please refer to the following embodiment.

Figure 11:
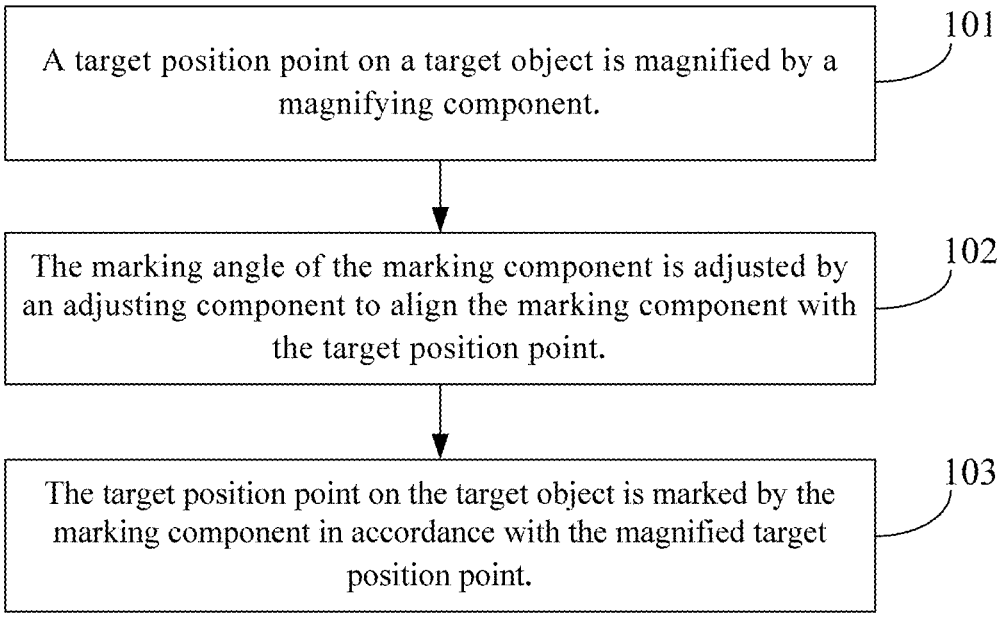
FIG. 11 is a flow chart of a marking method provided in the present disclosure.

Referring to FIG. 11, which shows a method flow chart of a marking method provided in the embodiments of the present disclosure. The marking method may be applied to the marking device as shown in any of FIG. 3 to FIG. 10. Referring to FIG. 11, the method comprises the following steps.

Step 101, a target position point on a target object is magnified by a magnifying component.

Figure 12:
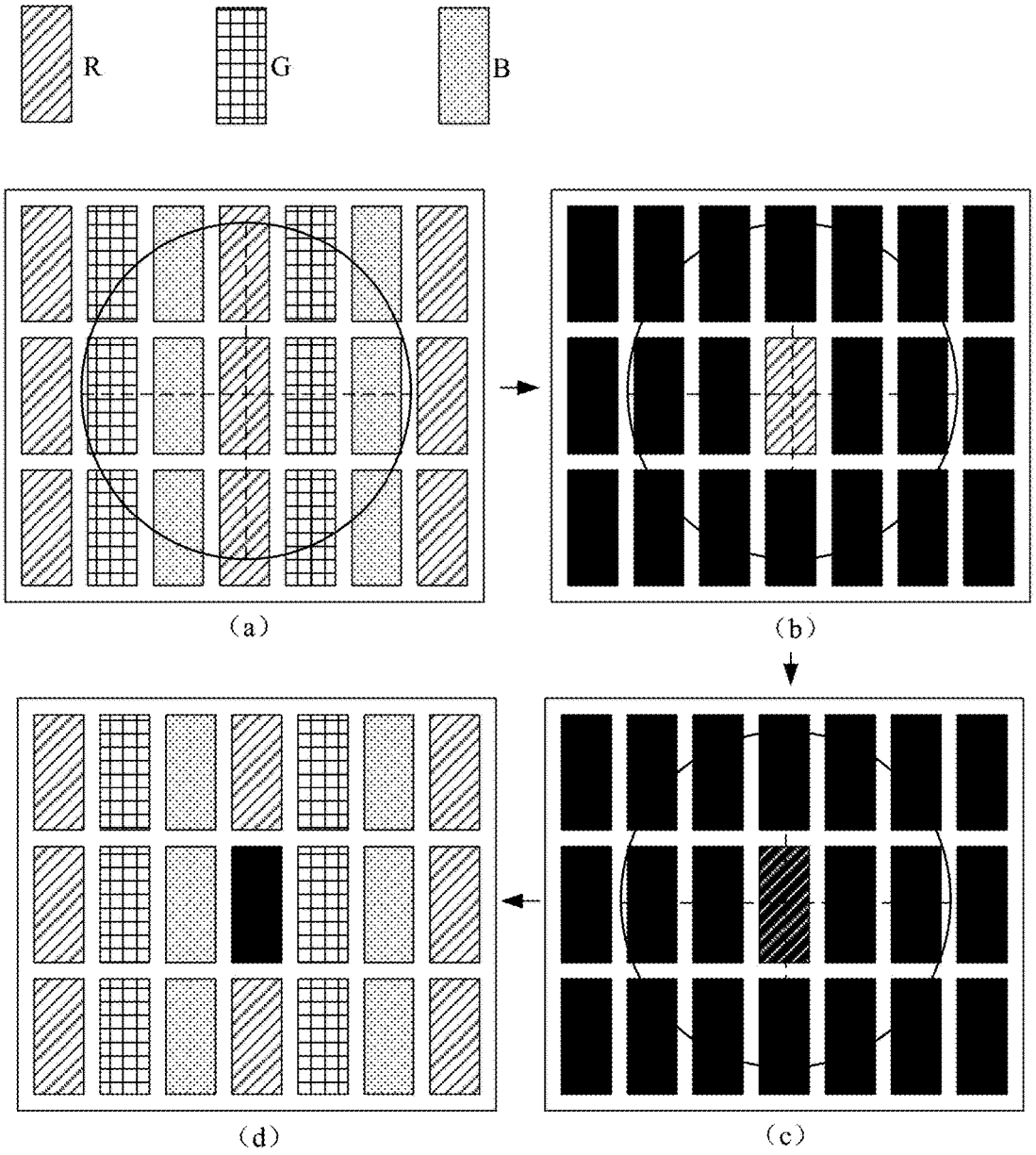
FIG. 12 is a schematic diagram of process of repairing a defective position point provided in the present disclosure.

In some embodiments, the target object may be a display panel, and may be a liquid crystal display panel, an OLED display panel or a QLED display panel. The display panel has a plurality of sub-pixels. The target position point may be a defective position point on the display panel, and is generally a sub-pixel point. The magnifying component is provided with a magnifying lens, and the defective position point on the display panel may be magnified by the magnifying lens. Exemplarily, as shown in FIG. 12(*a*), the display panel has red (R) sub-pixels, green (G) sub-pixels and blue (B) sub-pixels, and the target position point may be the R sub-pixel point in the center of the display panel. In the embodiments of the present disclosure, the R sub-pixel point may be magnified by the magnifying component in the lighting state of the display panel, and the magnified R sub-pixel point may be observed with naked eyes.

It should be noted that in the observation process, as shown in FIG. 12(*b*), the pictures may be switched to find the picture where the target position point is the most obvious. In the picture, it can be clearly observed that the target position point is a sub-pixel point, and the picture may be a L (level) 0 picture. Here, L represents the gray level of the picture, L0 represents that the gray level of the picture is 0, and the L0 picture is a black state picture.

Step 102, the marking angle of the marking component is adjusted by an adjusting component to align the marking component with the target position point.

In some embodiments, the adjusting component comprises an adjusting knob, an adjusting part and m adjusting gears meshed in sequence. The marking component may comprise a nozzle that is disposed on the adjusting part. The adjusting knob may be rotated to rotate the rotary gear of the adjusting knob, so as to drive the adjusting gear meshed with the rotary gear to rotate, such that the m adjusting gears are driven in sequence. Finally, the adjusting part is driven to rotate to adjust the jetting angle of the nozzle, so as to align the nozzle with the target position point.

It should be noted that in the embodiments of the present disclosure, in a process of adjusting the marking angle of the marking component through the adjusting component, the adjusting component may be assisted by an auxiliary adjusting component. The auxiliary adjusting component may comprise an infrared laser aligner. The infrared laser aligner is disposed in the nozzle of the marking component, and the infrared rays emitted by the infrared laser aligner may be collinear with the axis of the nozzle. In the process of rotating the adjusting knob, when the projection point of the infrared rays emitted by the infrared laser aligner on the display panel coincides with the target position point, the nozzle is aligned with the target position point.

Step 103, the target position point on the target object is marked by the marking component in accordance with the magnified target position point.

After the marking component is aligned with the target position point, the target position point on the target object may be marked by the marking component in accordance with the magnified target position point. In some embodiments, the marking component comprises an inkjet. The inkjet comprises an ink cartridge and a nozzle communicated with the ink cartridge, and the nozzle may jet ink to the target position point in accordance with the magnified target position point, to mark the target position point. The schematic view of the marked target position point is as shown in FIG. 12(*c*). In the embodiments of the present disclosure, the ink may be semitransparent, and even though in a non L0 picture, the target sub-pixel (i.e., the sub-pixel at the target position point) can be more clearly differentiated from other sub-pixels, thereby achieving the purpose of marking the target position point.

It should be noted that in the embodiments of the present disclosure, after the target position point is marked, the defective position point may be directly repaired by a laser repair accurately, and the repaired display panel is as shown in FIG. 12(*d*). After the defective position point is marked with the marking method provided in the embodiments of the present disclosure, the repair of the defective position point can be smoothly finished, thereby achieving the purpose of enhancing productivity and yield. In the embodiments of the present disclosure, the ink is an oily material. After the defective position point is repaired, the ink at the defective position point may be wiped by alcohol without leaving a stain and generating an adverse effect on the product.

In conclusion, in accordance with the marking method provided in the embodiments of the present disclosure, the marking component can mark the target position point on the target object in accordance with the target position point magnified by the magnifying component, and the target position point on the target object can be the defective position point on the display panel. Therefore, there is no need to confirm the defective position point after marking, and it is helpful for solving the problem of the complicated operation process of marking the defective position point in the related art and simplifying the operation process of marking the defective position point.

The embodiments of the present disclosure further provide a repair system for a display panel. The repair system comprises the marking device as shown in any one of FIG. 3 to FIG. 10.

In some embodiments, the repair system for a display panel may also comprise a repair device, and the repair device may be a laser repair.

Understandably, the term "and/or" herein describes the correspondence of the corresponding objects, indicating three kinds of relationship. For example, A and/or B, can be expressed as: A exists alone, A and B exist concurrently, B exists alone. The character "/" generally indicates that the context object is an "OR" relationship.

Persons of ordinary skill in the art can understand that all or part of the steps described in the above embodiments can be completed through hardware, or through relevant hardware instructed by applications stored in a non-transitory computer readable storage medium, such as read-only memory, disk or CD, etc.

The foregoing are merely optional embodiments of the present disclosure, and are not intended to limit the present disclosure. Within the spirit and principles of the disclosure, any modifications, equivalent substitutions, improvements, etc., are within the scope of protection of the present disclosure.

What is claimed is:

1. A marking device, comprising a magnifying component, a marking component, an adjusting component and an auxiliary adjusting component, wherein the magnifying component is configured to magnify a target position point on a target object;

the marking component is configured to mark the target position point on the target object in accordance with the magnified target position point, the adjusting component is connected to the marking component and configured to adjust a marking angle of the marking component to align the marking component with the target position point, and the auxiliary adjusting component is disposed in the marking component and configured to assist the adjusting component in adjusting the marking angle of the marking component, wherein the marking component comprises: an inkjet configured to jet ink to the target position point so as to mark the target position point, the inkjet comprises an ink cartridge and a nozzle communicated with the ink cartridge, the auxiliary adjusting component comprises an infrared laser aligner, the infrared laser aligner is disposed in the nozzle and infrared rays emitted by the infrared laser aligner are collinear with an axis of the nozzle; and the adjusting component is configured to adjust an ink jetting angle of the nozzle in accordance with the infrared rays emitted by the infrared laser aligner.

2. The device according to claim 1, wherein the inkjet further comprises a recycling case communicated with the nozzle and configured to recycle residual ink in the nozzle.

3. The device according to claim 2, wherein the adjusting component comprises an adjusting knob, an adjusting part and m adjusting gears meshed in sequence, and m is an integer greater than or equal to 1, the adjusting knob is provided with a rotary gear, wherein the rotary gear is meshed with a first adjusting gear of the m adjusting gears, a shaft of a second adjusting gear of the m adjusting gears is fixedly connected to the adjusting part, the nozzle is fixedly disposed on the adjusting part, and the first adjusting gear and the second adjusting gear are adjusting gears disposed at both ends among the m adjusting gears meshed in sequence.

4. The device according to claim 3, wherein the nozzle is a piezoelectric stack nozzle.

5. The device according to claim 4, further comprising a power supply component connected to the piezoelectric stack nozzle and configured to supply power to the piezoelectric stack nozzle.

6. The device according to claim 5, further comprising a control component electrically connected to the nozzle and the infrared laser aligner respectively and configured to control the infrared laser aligner to emit infrared rays and control the nozzle to jet ink.

7. The device according to claim 6, wherein the control component comprises a nozzle switch electrically connected to the nozzle and an aligner switch electrically connected to the infrared laser aligner.

8. The device according to claim 7, further comprising a jet head support of a hollow structure and provided with a knob opening and a nozzle opening, wherein the ink cartridge, the nozzle, the recycling case, the infrared laser aligner, the adjusting knob, the adjusting part, the m adjusting gears and the power supply component are all disposed in the jet head support, the adjusting knob partially extends out of the knob opening, and the ink jetted by the nozzle is enabled to be jetted out of the jet head support through the nozzle opening.

9. The device according to claim 8, further comprising a magnifier body of a hollow structure and fixedly connected to the jet head support, wherein the magnifying component comprises a magnifying lens disposed in the magnifier body.

10. The device according to claim 3, wherein m is equal to 3.

11. The device according to claim 1, wherein the nozzle is provided with a penetration hole, and the infrared laser aligner is enabled to pass the nozzle through the penetration hole.

12. The device according to claim 11, wherein a value range of an aperture of the penetration hole is 20 micrometers to 30 micrometers.

13. A marking method of a marking device according to claim 1, wherein the method comprises:

magnifying a target position point on a target object by the magnifying component; and marking the target position point on the target object by the marking component in accordance with the magnified target position point.

14. The method according to claim 13, before marking the target position point on the target object by the marking component in accordance with the magnified target position point, further comprising: adjusting a marking angle of the marking component by an adjusting component to align the marking component with the target position point.

15. The method according to claim 14, wherein adjusting the marking angle of the marking component by an adjusting component comprises:

assisting the adjusting component in adjusting the marking angle of the marking component by an auxiliary adjusting component.

16. A repair system of a display panel, comprising a marking device according to claim 1.

* * * * *